US009951437B2

(12) United States Patent
Tsai et al.

(10) Patent No.: US 9,951,437 B2
(45) Date of Patent: Apr. 24, 2018

(54) INSULATOR PLATE FOR METAL PLATING CONTROL

(71) Applicant: Taiwan Semiconductor Manufacturing Company Limited, Hsin-Chu (TW)

(72) Inventors: Ming-Chin Tsai, Hsinchu (TW); Chun-Yi Lee, Beipu Township (TW); Victor Y. Lu, Hsinchu (TW)

(73) Assignee: Taiwan Semiconductor Manufacturing Company Limited, Hsin-Chu (TW)

( * ) Notice: Subject to any disclaimer, the term of this patent is extended or adjusted under 35 U.S.C. 154(b) by 749 days.

(21) Appl. No.: 13/971,459

(22) Filed: Aug. 20, 2013

(65) Prior Publication Data

US 2015/0053550 A1 Feb. 26, 2015

(51) Int. Cl.

*C25D 17/00* (2006.01)
*C25D 17/02* (2006.01)
*C25D 21/12* (2006.01)

(52) U.S. Cl.

CPC ..... *C25D 17/001* (2013.01); *C25D 17/008* (2013.01)

(58) Field of Classification Search

CPC .... C25D 17/00; C25D 17/001; C25D 17/005; C25D 17/008; C25D 17/007; C25D 17/02; C25D 21/12

USPC ..... 204/242

See application file for complete search history.

(56) References Cited

U.S. PATENT DOCUMENTS

| | | | | |
|---|---|---|---|---|
| 6,773,571 | B1 * | 8/2004 | Mayer | C25D 17/12 204/232 |
| 7,622,024 | B1 | 11/2009 | Mayer et al. | |
| 2010/0032310 | A1 * | 2/2010 | Reid | C25D 21/12 205/261 |
| 2012/0000786 | A1 * | 1/2012 | Mayer | C25D 5/08 205/143 |
| 2013/0134045 | A1 * | 5/2013 | Porter | C25D 17/001 205/158 |

* cited by examiner

*Primary Examiner* — Zulmariam Mendez

(74) *Attorney, Agent, or Firm* — Cooper Legal Group, LLC

(57) ABSTRACT

Among other things, one or more systems and techniques for promoting metal plating uniformity are provided. An insulator plate is positioned relative to a semiconductor wafer that is to be electroplated with metal during a metal plating process. The insulator plate comprises an insulator ring that provides a resistance to electrical plating current passing through the insulator ring to the semiconductor wafer. The insulator plate comprises one or more porous regions, such as holes, that introduce little to no additional resistance to electrical plating current passing through such porous regions to the semiconductor wafer. The insulator plate influences electrical plating current so that edge plating current has a current value similar to a center plating current. The similarity in plating current promotes metal plating uniformity for the semiconductor wafer.

20 Claims, 10 Drawing Sheets

INSULATOR PLATE FOR METAL PLATING CONTROL

BACKGROUND

A metal plating process is performed for electroplating metal onto a semiconductor wafer, such as within trenches, via structures, or other portions of the semiconductor wafer. In an example, a seed layer, such as a copper layer, is formed over a surface of the semiconductor wafer. The seed layer carries electrical plating current from a wafer edge of the semiconductor wafer across the surface of the semiconductor wafer. The electrical plating current is supplied by a power source that is connected to an anode and is connected to the wafer edge as a cathode. The electrical plating current provides electrons that convert metal ions to metal atoms that accumulate on the surface of the semiconductor wafer. The seed layer has a resistance from the wafer edge to a center region of the semiconductor wafer, which results in a voltage drop causing a terminal effect where the electrical plating current is higher at the wafer edge than the center region. The higher electrical plating current results in a greater accumulation of metal atoms at the wafer edge than the center region, thus resulting in non-uniformity issues across the wafer.

DETAILED DESCRIPTION

Figure 1:
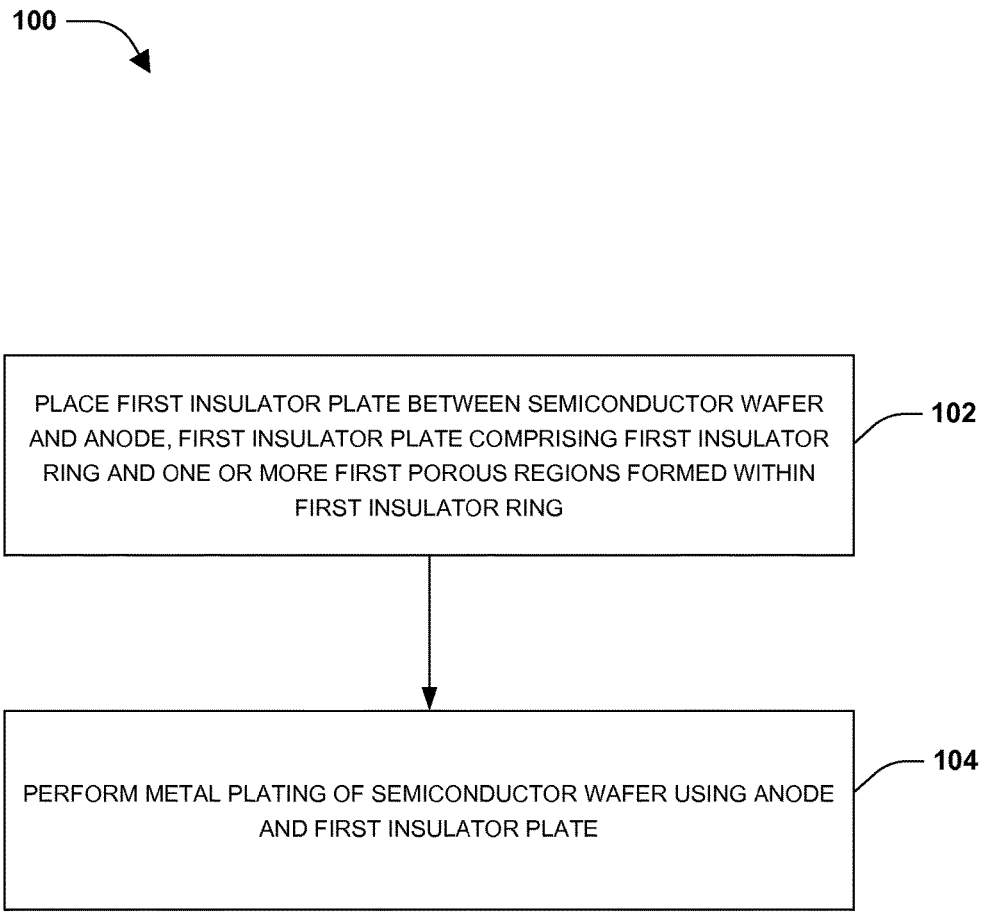
FIG. 1 is a flow diagram illustrating a method of promoting metal plating profile uniformity using a first insulator plate, according to some embodiments.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

One or more systems and methods for promoting metal plating profile uniformity are provided herein. A metal plating process is performed upon a semiconductor wafer within a container, such as a plating cell. Electrical plating current is provided to the plating cell, such as from an anode to the semiconductor wafer to electroplate metal onto the semiconductor wafer. An edge plating current corresponds to electrical plating current directed towards a wafer edge of the semiconductor wafer and a center plating current corresponds to electrical plating current directed towards a center potion of the semiconductor wafer. One or more insulator plates are disposed between the semiconductor wafer and the anode. A first insulator plate comprises a first insulator ring formed around a center porous region. The first insulator ring comprises an insulator material, such as telfon or a ceramic material, which increases an edge resistance of a current path traveled by the edge plating current to the wafer edge. Increasing the edge resistance results in the edge plating current having a current value similar to a current value of the center plating current. Controlling the electrical plating current, such as the edge plating current, compensates for a resistance across a surface of the semiconductor wafer that would otherwise result in a relatively larger edge plating current than the center plating current, at times referred to as a terminal effect. The terminal effect results in more metal atoms accumulating on the wafer edge of the semiconductor wafer than the center portion of the semiconductor wafer. In this way, maintaining a similar electrical plating current for the semiconductor wafer mitigates the terminal effect, and thus promotes uniform metal plating across the surface of the semiconductor wafer.

A method 100 of promoting metal plating profile uniformity is illustrated in FIG. 1. In an embodiment, a seed layer, such as a copper layer, is formed over a surface of a semiconductor wafer. The semiconductor wafer is placed into a container, such as a plating cell, within which a metal plating process is performed to electroplate metal onto the semiconductor wafer. The plating cell comprises an electrolyte solution that facilitates the metal plating process. An electrical plating current is supplied to the plating cell so that the electrical plating current provides electrons that convert metal ions, within the electrolyte solution, to metal atoms that accumulate on the surface of the semiconductor wafer. Because the seed layer creates a resistance between a wafer edge and a center portion of the semiconductor wafer, a voltage drop occurs between the wafer edge and center portion. The voltage drop results in a decreased center plating current with respect to an edge plating current. The decreased center plating current results in relatively less accumulation of metal atoms at the center portion compared to metal atom accumulation at the wafer edge. The difference in metal atom accumulation or metallization between the wafer edge and the center potion results in the semiconductor wafer having a non-uniformity issues. Accordingly, as provided herein, one or more insulator plates are used to control the electrical plating current during the metal plating process so that the edge plating current and the center plating current have relatively similar current values.

At 102, a first insulator plate is disposed between the semiconductor wafer and an anode of the plating cell. The first insulator plate comprises a first insulator ring formed around a center porous region, such as a first hole (e.g., first insulator plate 204 comprising a first insulator ring 204*a* formed around a center porous region 204*b* of FIG. 2). In an embodiment, the first insulator ring is formed as a single solid ring (e.g., FIG. 2). In an embodiment, the first insulator ring comprises an insulator material, such as telfon, ceramic, or other insulator. In an embodiment, the first insulator ring comprises one or more porous regions, such as one or more holes, formed within the first insulator ring (e.g., FIG. 3A). A porous region is formed according to any shape, size, or distribution. In an embodiment, the porous region has one or more adjustable sizes such as a first selectable size and a second selectable size. In an embodiment, a first set of porous regions, formed within the first insulator ring, have a first distribution density and a second set of porous regions, formed within the first insulator ring, have a second distribution density different than the first distribution density. In an embodiment, the first set of porous regions are located near a center portion of the first insulator ring and have a relatively high density so that center plating current flows through the first set of porous regions to a center portion of the semiconductor wafer with little to no resistance from the first insulator ring. In an embodiment, the second set of porous regions are located near a ring edge of the first insulator ring and have a relatively low density so that edge plating current, directed towards a wafer edge of the semiconductor wafer, is reduced due to a resistance introduced by the first insulator ring. In an embodiment, a first porous region has a first size, and a second porous region has a second size different than the first size. In an embodiment, the first porous region has a first shape, and the second porous region has a second shape different than the first shape. In an embodiment, the one or more porous regions have a non-uniform distribution throughout the first insulator ring. In an embodiment, the first insulator plate has a porosity of 10% or greater based upon the one or more porous regions and the center porous region.

At 104, a metal plating process is performed on the semiconductor wafer using the anode and the first insulator plate. A power source is connected to the anode and the wafer edge of the semiconductor wafer. An electrical plating current is generated from the anode to the semiconductor wafer. The first insulator plate is used to control the electrical plating current, such as decreasing the edge plating current directed towards the wafer edge of the semiconductor wafer or refraining from modifying the center plating current directed towards the center portion of the semiconductor wafer. The first insulator ring of the first insulator plate comprises an insulator material that increases a resistance for the edge plating current. In contrast, porous regions, such as the center porous region, of the first insulator ring introduce little to no additional resistance for the center plating current. Porous regions are arranged within the first insulator plate such that edge plating current, directed towards the wafer edge of the semiconductor wafer, is reduced because the insulator material increases an edge resistance through which the edge plating current is to travel. Porous regions are arranged within the first insulator plate such that center plating current, directed towards the center potion of the semiconductor wafer, passes through such porous regions relatively unaffected. The increased edge resistance introduced by the first insulator ring compensates for or offsets a wafer resistance introduced by the seed layer. In an embodiment, the edge resistance introduced by the first insulator ring reduces the edge plating current such that the edge plating current has a current value that is similar to a current value of the center plating current, considering that the wafer resistance serves to reduce the center plating current. Because the center plating current and the edge plating current have similar current values, metal atoms accumulate on the surface of the semiconductor wafer in a more uniform or conformal manner so that the wafer edge and the center portion of the semiconductor wafer have similar thicknesses.

Figure 6A:
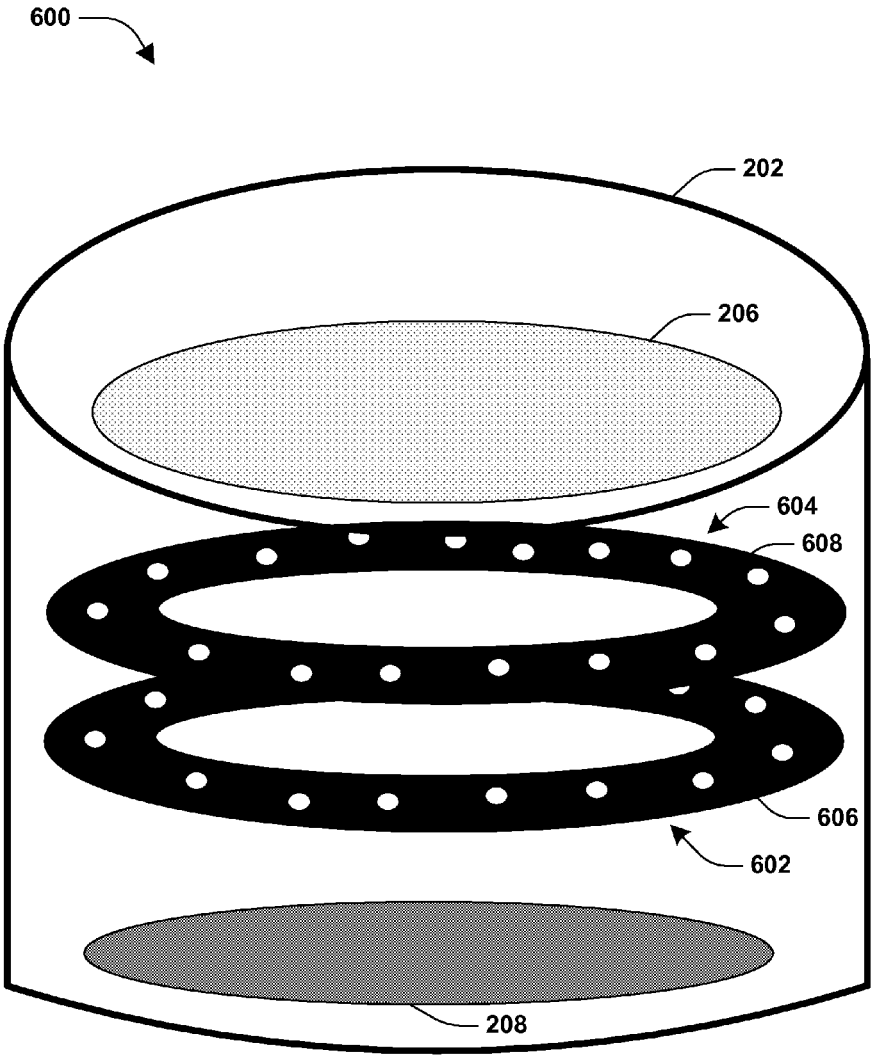
FIG. 6A is an illustration of a system for promoting metal plating profile uniformity using a first insulator plate and a second insulator plate, according to some embodiments.

In an embodiment, multiple insulator plates are disposed between the semiconductor wafer and the anode (e.g., FIG. 6A). In an embodiment, a second insulator plate, comprising a second insulator ring and one or more second porous regions formed within the second insulator ring, is disposed between the semiconductor wafer and the first insulator plate. The one or more second porous regions are formed according to a second distribution density that is the same or different than a first distribution density according to which the one or more porous regions are formed within the first insulator plate. The one or more second porous regions have shapes, sizes, or positions that are the same or different than the one or more porous regions of the first insulator plate. In this way, the first insulator plate and the second insulator plate are configured similarly or differently to promote metal plating profile uniformity.

Figure 3A:
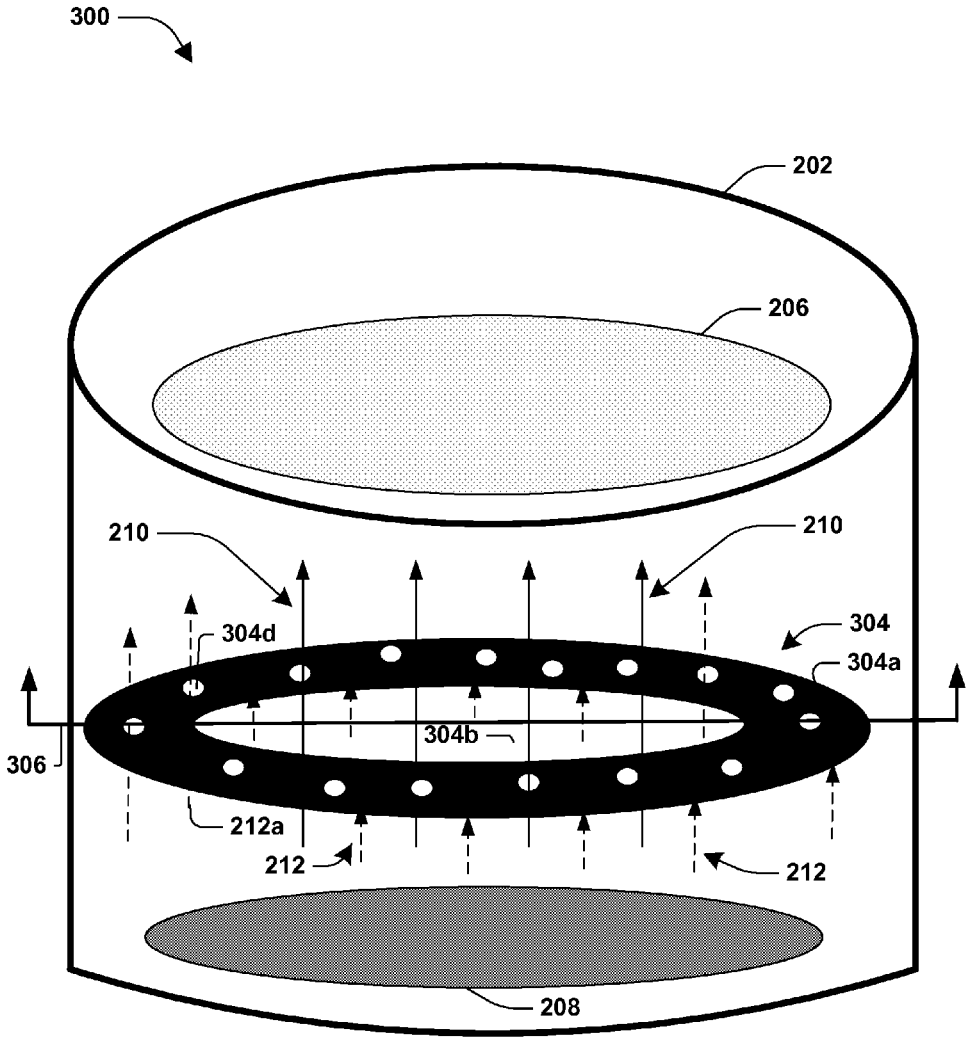
FIG. 3A is an illustration of a system for promoting metal plating profile uniformity using a first insulator plate comprising a center porous region and one or more porous regions, according to some embodiments.
Figure 3B:
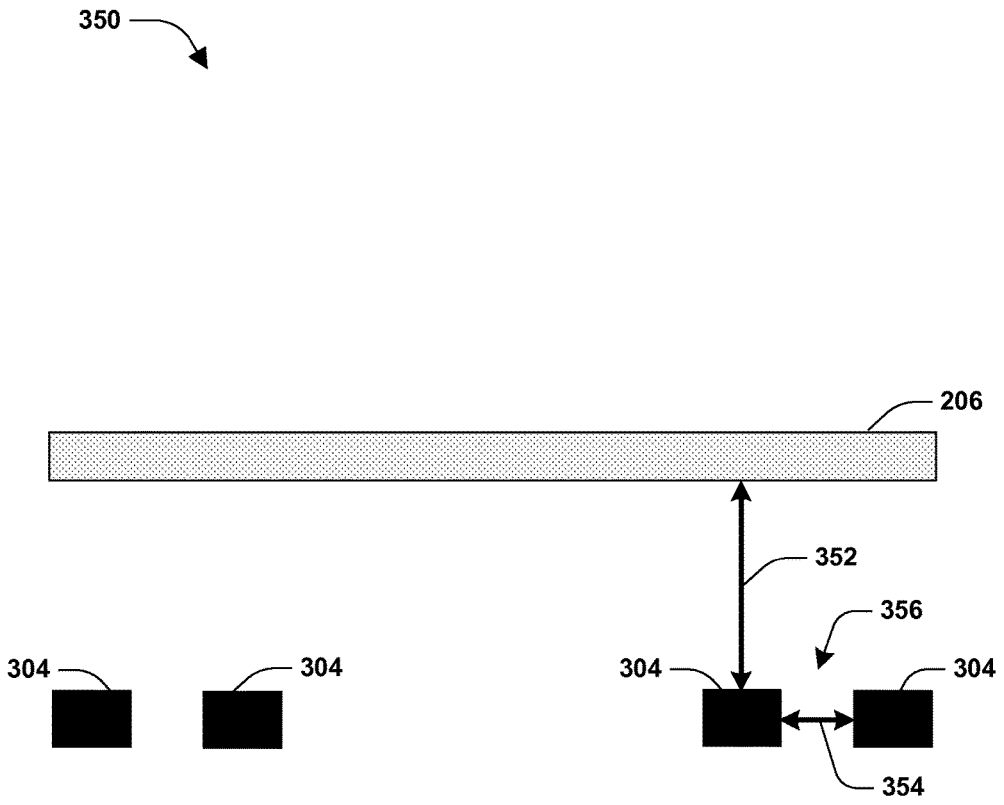
FIG. 3B is an illustration of a cross-sectional view of a system for promoting metal plating profile uniformity using a first insulator plate comprising a center porous region and one or more porous regions, according to some embodiments.

In an embodiment, a first distance between the first insulator plate and the semiconductor wafer is adjusted (e.g., FIG. 3B). In an embodiment, a second distance between the first insulator plate and the second insulator plate is adjusted (e.g., FIG. 6C). In an embodiment, the first insulator plate is rotated with respect to the second insulator plate (e.g., FIG. 6B). In this way, one or more insulator plates disposed between the semiconductor wafer and the anode are configured and adjusted to influence electrical plating current for a uniform plating profile or other desired plating profiles.

Figure 2:
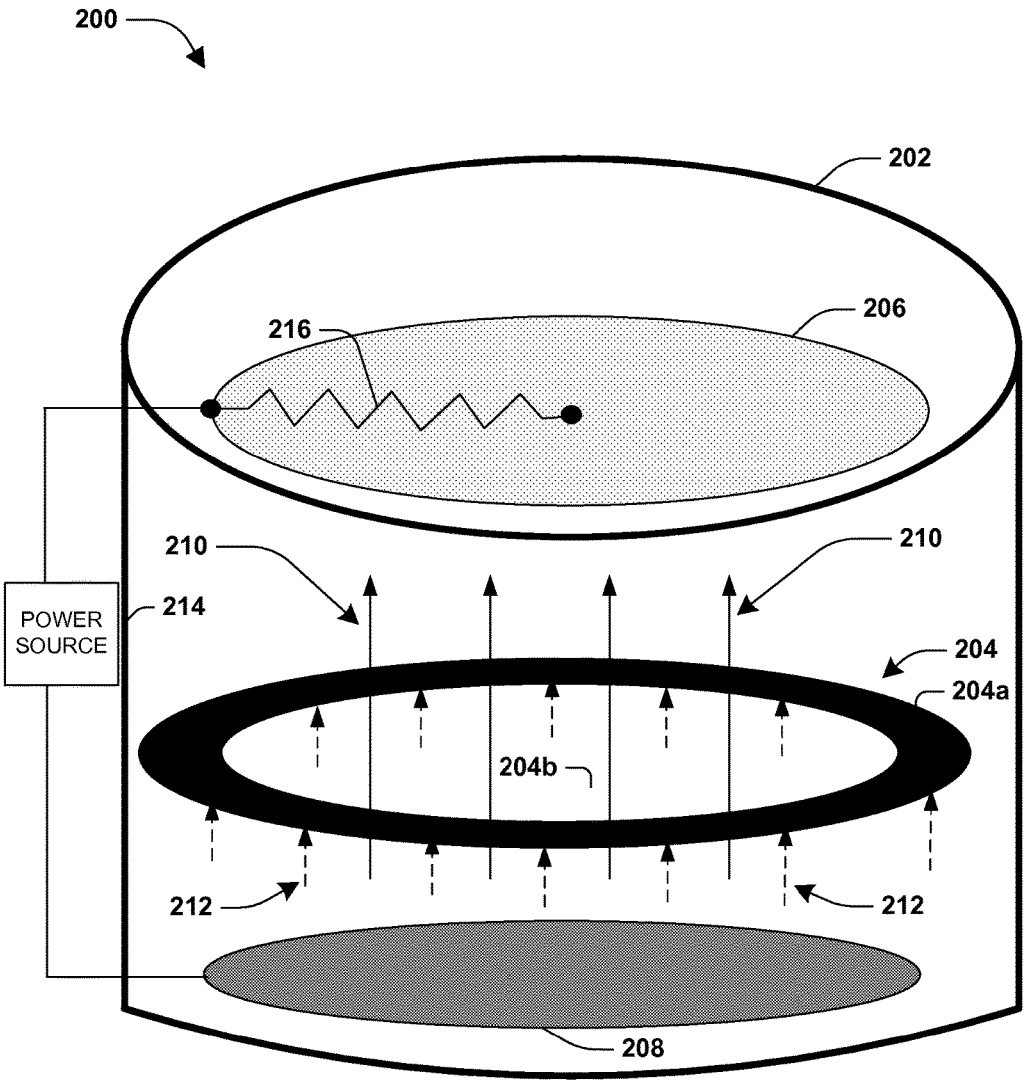
FIG. 2 is an illustration of a system for promoting metal plating profile uniformity using a first insulator plate comprising a center porous region, according to some embodiments.

FIG. 2 illustrates a system 200 for promoting metal plating profile uniformity. The system 200 comprises a first insulator plate 204. The first insulator plate 204 comprises a first insulator ring 204*a* formed to define a center porous region 204*b*. The first insulator plate 204 is disposed between a semiconductor wafer 206 and an anode 208 within a plating cell 202. A power source 214 is connected to the anode 208 and to a wafer edge of the semiconductor wafer 206 which acts as a cathode. A plating cell 202 comprises an electrolyte solution used to facilitate a metal plating process performed to electroplate metal onto the semiconductor wafer 206. When active, the power source 216 generates an electrical plating current, such as center plating current 210 (illustrated as solid lines) and edge plating current 212 (illustrated as dashed lines), that provides electrons that convert metal ions, within the electrolyte solution, to metal atoms that accumulate on the surface of the semiconductor wafer 206. In an embodiment, a seed layer, such as a copper layer, is formed over a surface of the semiconductor wafer 206 to facilitate the metal plating process. The seed layer has a wafer resistance 216 between the wafer edge and a center portion of the semiconductor wafer 206, which results in a voltage drop between the wafer edge and the center portion. The voltage drop leads to a terminal effect that reduces electrical plating current that reaches the center portion thus resulting in greater accumulation of metal atoms at the wafer edge than at the center portion. The greater accumulation of metal atoms at the wafer edge results in a non-uniform plating profile for the semiconductor wafer 206 where the wafer edge is thicker than the center portion.

Accordingly, the first insulator plate 204 is used during the metal process to modify the electrical plating current.

The first insulator ring 204*a* comprises an insulator material that increases an edge resistance through which the edge plating current 212 is to travel to reach the wafer edge of the semiconductor wafer 206, thus reducing the edge plating current 212. The center porous region 204*b* does not increase resistance of a current path through which the center plating current 210 is to travel to reach the center portion of the semiconductor wafer 206, which is desirable because the center plating current 210 is already decreased by the wafer resistance 216. In this way, the edge plating current 212, reduced by the resistance introduced by the first insulator ring 204*a,* has a current value similar to a current value of the center plating current 210, reduced by the wafer resistance 216, passing through the center porous region 204*b*. The similarity between the center plating current 210 and the edge plating current 212 promotes metal plating uniformity.

FIG. 3A illustrates a system 300 for promoting metal plating profile uniformity. The system 300 comprises a first insulator plate 304. The first insulator plate 304 comprises a first insulator ring 304*a* formed to define a center porous region 304*b*. The first insulator plate 304 comprises one or more porous regions formed within the first insulator ring 304*a*, such as a first porous region 304*d*. The first insulator plate 304 is disposed between a semiconductor wafer 206 and an anode 208 within a plating cell 202. The center porous region 304*b* and the one or more porous regions allow electrical plating current, such as center plating current, to travel through such porous regions with little to no increase in a resistance path. In an embodiment, a center plating current 210 passes through the center porous region 304*b*. In an embodiment, a first edge plating current 212*a* passes through the first porous region 340*d*. The first insulator ring 304*a* comprises an insulator material that increases a resistance for electrical plating current, such as edge plating current 212, that travels through the insulator material. In this way, the edge plating current 212, reduced by the resistance introduced by the first insulator ring 304*a,* has a current value similar to a current value of the center plating current 210. The similarity between the center plating current 210 and the edge plating current 212 results in metal plating uniformity.

FIG. 3B illustrates a system 350 for modifying a first insulator plate 304 during a metal plating process. In an embodiment, the first insulator plate 304 corresponds to the first insulator plate 304 of FIG. 3A such that FIG. 3B is a cross-sectional view illustrating the first insulator plate 304 and the semiconductor wafer along line 306 of FIG. 3A. The first insulator plate 304 is positioned below the semiconductor wafer 206. The first insulator plate 304 has one or more selectable distance settings used to modify a vertical distance 352 between the first insulator plate 304 and the semiconductor wafer 206. The first insulator plate 304 comprises a porous region 356, such as a hole, that has a configurable size 354. In this way, the vertical distance 352 and shapes, sizes, or configurations of porous regions of the first insulator plate 304 are configurable.

Figure 4:
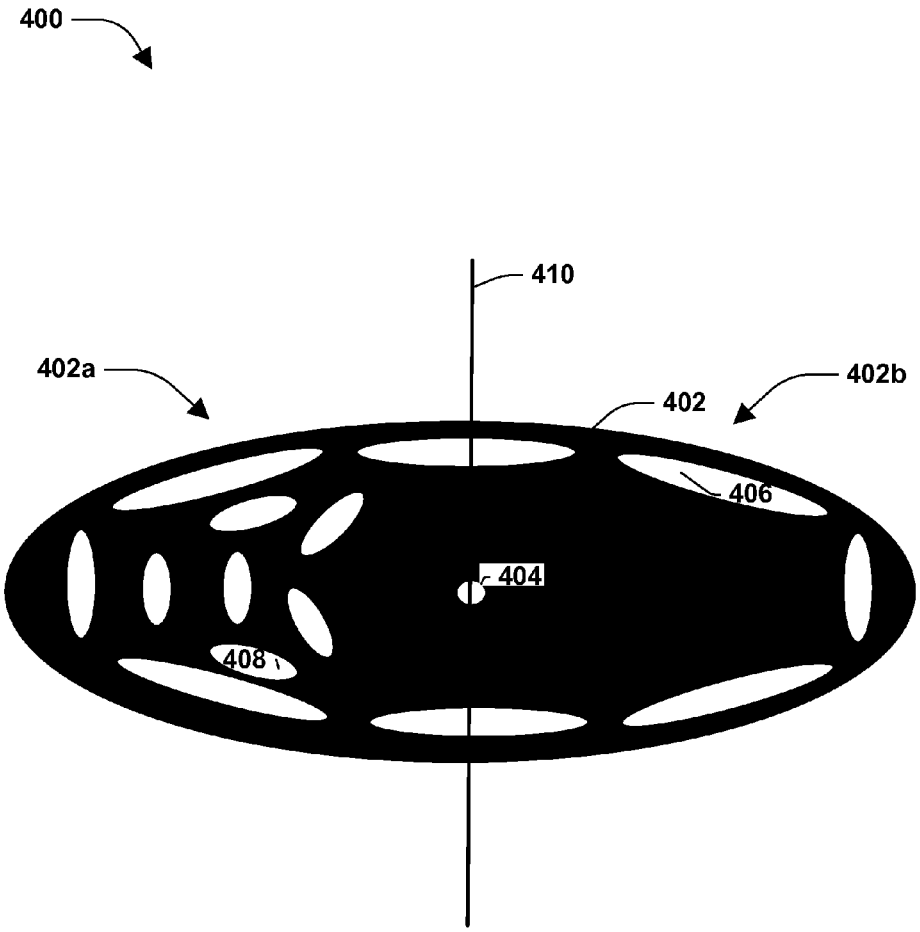
FIG. 4 is an illustration of a first insulator plate having a non-uniform distribution of porous regions, according to some embodiments.

FIG. 4 illustrates a first insulator plate 400 having a non-uniform distribution of porous regions, where plate 400 is used in a metal plating process to promote metal plating profile uniformity. The first insulator plate 400 comprises a first insulator ring 402 comprising an insulator material that increases resistance of a path for electrical plating current traveling through the first insulator ring 402. The first insulator plate 400 comprises a center porous region 404, such as a hole, that does not or that substantially does not increase resistance of a current path for electrical plating current through the center porous region 404, such as center plating current. The first insulator plate 400 comprises one or more porous regions, such as holes, that do not or that substantially do not increase resistance of a current path for electrical plating current through such porous region, such as edge plating current. In an embodiment, the first insulator plate 400 comprises a first porous region 406, a second porous region 408, or other porous regions. The first porous region 406 has a first size that is different than a second size of the second porous region 408. A first set of porous regions formed within a first region 402*a* of the first insulator plate 400, such as a first portion of the first insulator plate 400 to the left of line 410, have a first distribution density such as a relatively high distribution density. A second set of porous regions formed within a second region 402*b* of the first insulator plate 400, such as a second portion of the of the first insulator plate 400 to the right of the line 410, have a second distribution density such as a relatively low distribution density, as compared to the first distribution density. The relatively high distribution density of the first set of porous regions allows electrical plating current to pass through with less resistance than the second set of porous regions having the relatively low distribution density because the second region 402*b* has more insulator material than the first region 402*a*. In this way, the first insulator plate 400 comprises porous regions with different sizes, shapes, or distribution densities.

Figure 5:
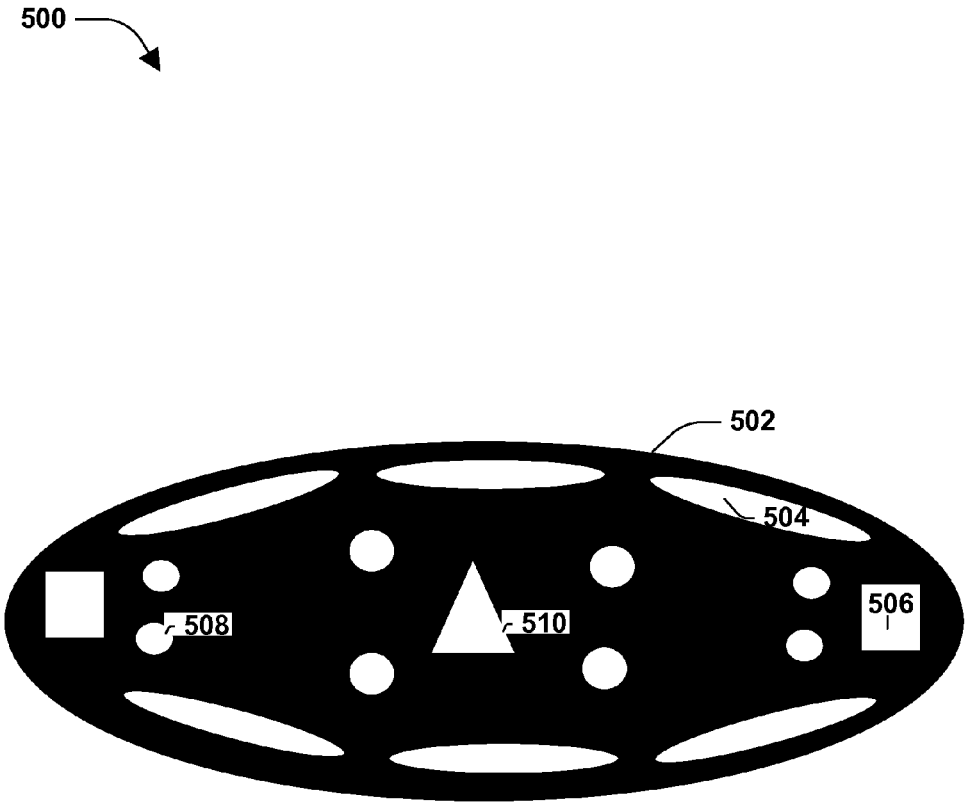
FIG. 5 is an illustration of a first insulator plate comprising porous regions having different shapes or sizes, according to some embodiments.

FIG. 5 illustrates a first insulator plate 500 comprising porous regions having different shapes or sizes, where plate 500 is used in a metal plating process to promote metal plating profile uniformity. The first insulator plate 500 comprises a first insulator ring 502 comprising an insulator material that increases resistance of a current path for electrical plating current through the first insulator ring 502. The first insulator plate 500 comprises a center porous region 510, such as a hole, that does not or that substantially does not increase resistance of a current path for electrical plating current, such as center plating current, through the center porous region 510. In an embodiment, the center porous region 510 has a triangular shape. The first insulator plate 500 comprises one or more porous regions, such as holes, that do not or that substantially do not increase resistance of a current path for electrical plating current through such porous regions. In an embodiment, the first insulator plate 500 comprises a first porous region 504, a second porous region 506, a third porous region 508, or other porous regions. In an embodiment, the first porous region 504 has an oblong shape that is different than a square shape of the second porous region 506 and a circular shape of the third porous region 508. In an embodiment, a shape of a porous region is modified. For example, a resizing component, such as an insulator material plate connected to the insulator plate 500 by a hinge structure, adjusts an area of the second porous region 506 by moving a portion of the insulator material plate over the second porous region 506 to decrease an area or size of the second porous region 506. In an embodiment, the first porous region 504 has a first size that is different than a second size of the second porous region 506, a third size of the third porous region 508, or a fourth size of the center porous region 510. In this way, the first insulator plate 500 comprises porous regions with different or adjustable sizes, shapes, or distribution densities.

FIG. 6A illustrates a system 600 for promoting metal plating profile uniformity. The system 600 comprises a first insulator plate 602 and a second insulator plate 604. The first insulator plate 602 comprises a first insulator ring 606. The second insulator plate 604 comprises a second insulator ring 608. The first insulator plate 602 is positioned between a semiconductor wafer 206 and an anode 208 of a plating cell 202. The second insulator plate 604 is positioned between the semiconductor wafer 206 and the first insulator plate 602. In an embodiment, the first insulator plate 602 comprises one or more first porous regions and the second insulator plate 604 comprises one or more second porous regions. In an embodiment, the one or more first porous regions are configured similar to the one or more second porous regions. In another embodiment, the one or more first porous regions are configured differently than the one or more second porous regions, such as having different sizes, number of porous regions, porous region locations, porous region distribution densities, porosity, etc. It is appreciated that any number of insulator plates are positioned within the plating cell 202 to influence electrical plating current.

Figure 6B:
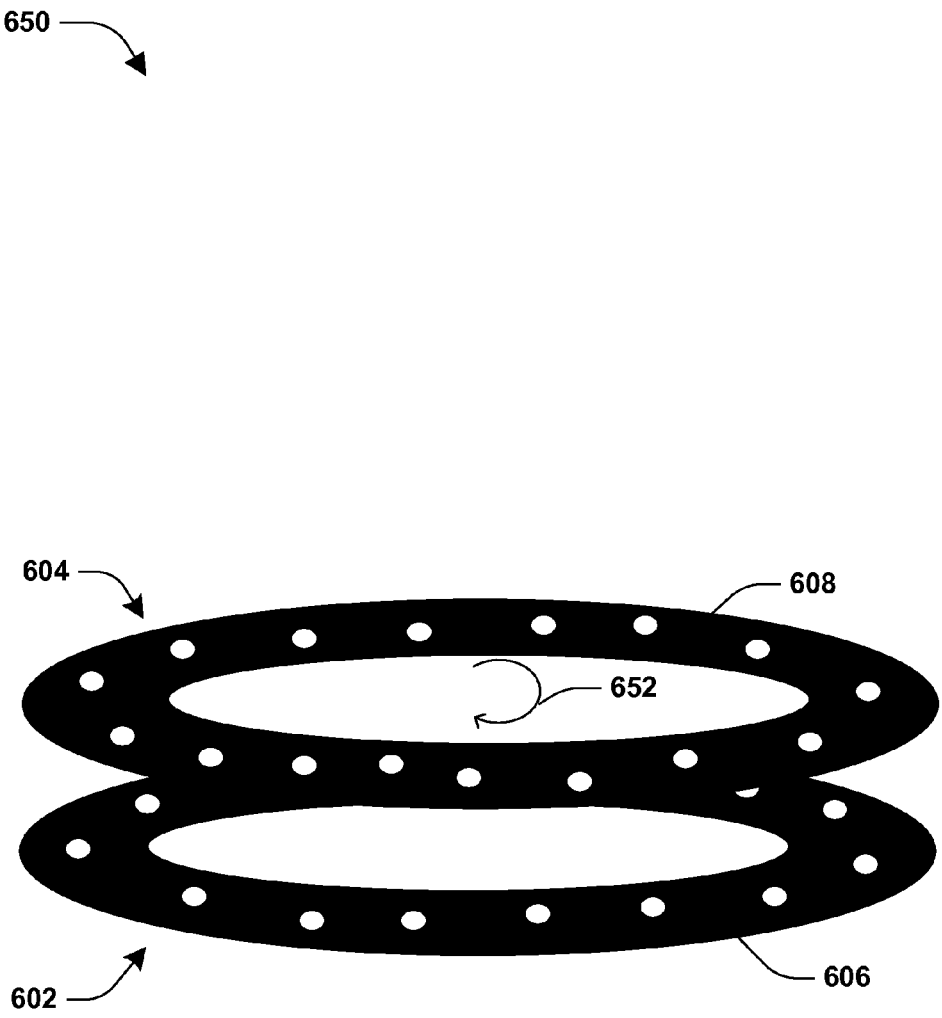
FIG. 6B is an illustration of a first insulator plate and a second insulator plate, according to some embodiments.

In an embodiment, the first insulator plate 602 and the second insulator plate 604 are rotated 652 relative to one another as illustrated in embodiment 650 of FIG. 6B. At least one of the second insulator plate 604 or the first insulator plate 602 are rotated to adjust how electrical plating current is influenced by the second insulator plate 604 and the first insulator plate 602. In an embodiment, the second insulator plate 604 is rotated to align a first porous region of the first insulator plate 602 with a second porous region of the second insulator plate 604 so that electrical plating current flows through the first porous region and the second porous region with little to no additional resistance from the first insulator plate 602 or the second insulator plate 604. In an embodiment, the second insulator plate 604 is rotated to align a first portion of the first insulator ring 606 of the first insulator plate 602 with a second portion of the second insulator ring 608 of the second insulator ring 604 to increase a resistance of a current path for electrical plating current through the first portion of the first insulator ring 606 and the second portion of the second insulator ring 608.

Figure 6C:
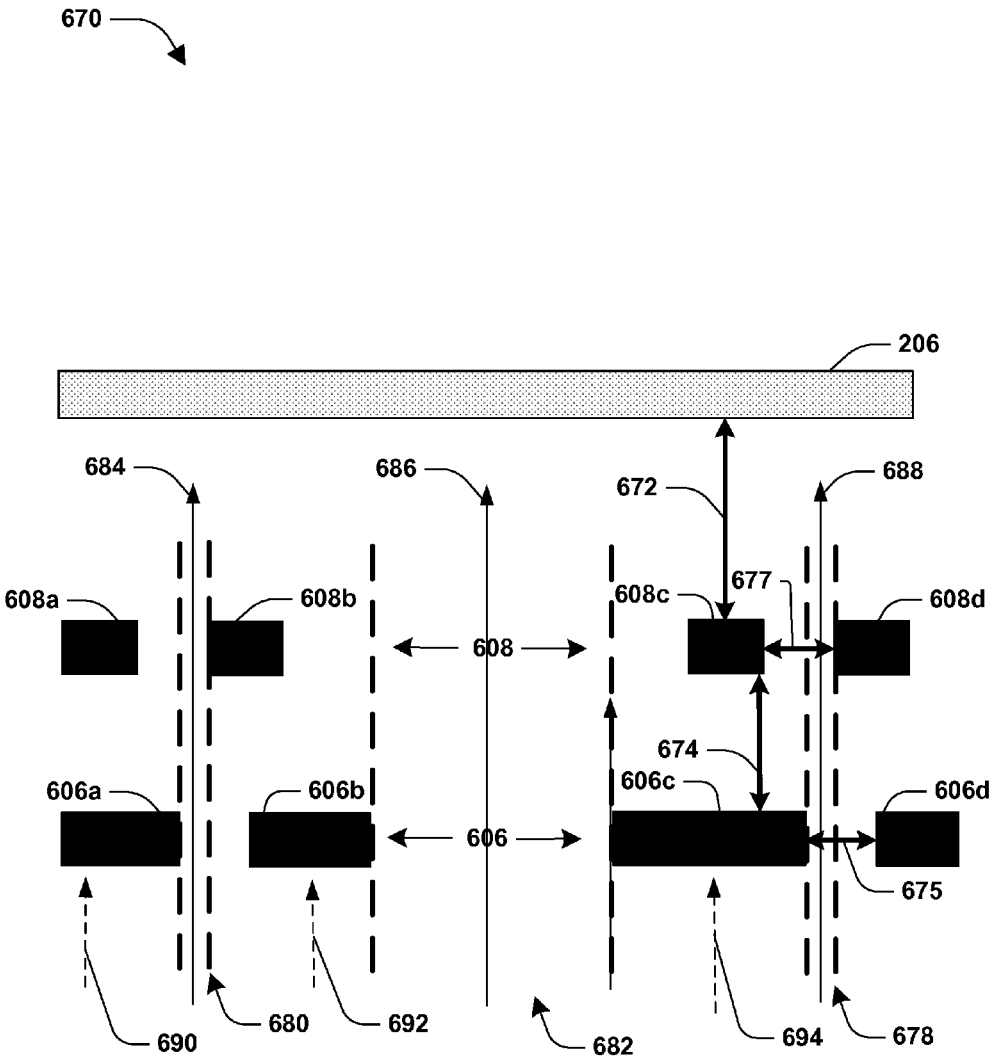
FIG. 6C is an illustration of a cross-sectional view of a system for promoting metal plating profile uniformity using a first insulator plate and a second insulator plate, according to some embodiments.

FIG. 6C illustrates a cross-sectional view 670 of a portion of system 600 of FIG. 6A. The system 600 comprises a first insulator plate 602 and a second insulator plate 604. The first insulator plate 602 comprises a first insulator ring 606. In an embodiment, the first insulator ring 606 comprises a first insulator ring portion 606*a,* a second insulator ring portion 606*b,* a third insulator ring portion 606*c,* and a fourth insulator ring portion 606*d.* The second insulator plate 604 comprises a second insulator ring 608. In an embodiment, the second insulator ring 608 comprises a fifth insulator ring portion 608*a,* a sixth insulator ring portion 608*b,* a seventh insulator ring portion 608*c,* and an eighth insulator ring portion 608*d.* The insulator ring portions comprise an insulator material that increases a resistance of a current path through which electrical plating current travels, such as first electrical plating current 690 through the first insulator ring portion 606*a* and the fifth insulator ring portion 608*a,* second electrical plating current 692 through the second insulator ring portion 606*b,* and third electrical plating current 694 through the third insulator ring portion 606*c* and the seventh insulator ring portion 608*c.* In this way, the first electrical plating current 690, the second electrical plating current 692, and the third electrical plating current 694 are reduced based upon the resistance created by such insulator ring portions, thus resulting in relatively less accumulation of metal atoms on corresponding surface portions of the semiconductor wafer 206.

The first insulator ring 606 and the second insulator ring 608 comprise one or more porous regions, such as holes, that do not or that substantially do not increase resistance for electrical plating current passing there through. For example, fourth electrical plating current 684 passes through porous regions 680, fifth electrical plating current 686 passes through porous regions 682, and sixth electrical plating current 688 passes through porous region 678 while experiencing little to no additional resistance from the first insulator plate 606 or the second insulator plate 608.

In an embodiment, the second insulator plate 604 has one or more selectable distance settings used to modify a vertical distance 672 between the second insulator plate 604 and the semiconductor wafer 206, such as by vertically re-positioning at least one of the second insulator plate 604 or the semiconductor wafer 206 within a plating cell. In an embodiment, the first insulator plate 602 has one or more selectable distance settings used to modify a vertical distance 674 between the first insulator plate 602 and the second insulator plate 604, such as by vertically re-positioning at least one of the first insulator plate 602 or the second insulator plate 604 within a plating cell. In an embodiment, the first insulator plate 602 comprises a porous region, such as between the third insulator ring portion 606*c* and the fourth insulator ring portion 606*d,* that has a configurable size 675, such as through the use of a shutter, one or more leafs, etc. In an embodiment, the second insulator plate 604 comprises a porous region, such as between the seventh insulator ring portion 608*c* and the eighth insulator ring portion 608*d,* that has a configurable size 677, such as through the use of a shutter, one or more leafs, etc. In this way, distances between components of a metal plating process are adjustable to promote metal plating profile uniformity. Similarly, shapes, sizes, or configurations of porous regions of one or more insulator plates are adjustable to promote metal plating profile uniformity in a metal plating process.

Figure 7:
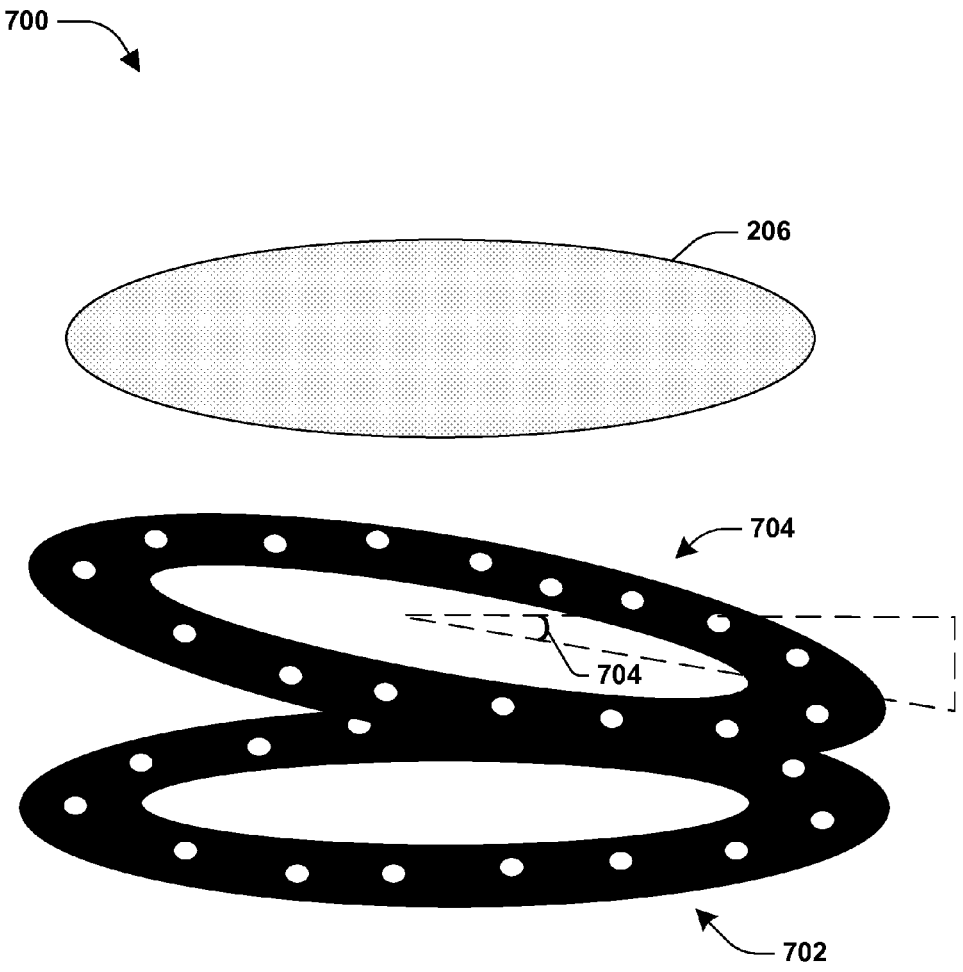
FIG. 7 is an illustration of a first insulator plate and a second insulator plate, according to some embodiments.

FIG. 7 illustrates an embodiment 700 of a first insulator plate 702 and a second insulator plate 704, where plates 702 and 704 are used in a metal plating process to promote metal plating profile uniformity. The first insulator plate 702 is positioned parallel to a semiconductor wafer 206. The second insulator plate 704 is tilted or adjusted with respect to the first insulator plate 702 or the semiconductor wafer 206. In an embodiment, the second insulator plate 704 is tilted at an angle 704 with respect to the first insulator plate 702, which results in realignment or misalignment between at least some porous regions of insulator rings of the first insulator plate 702 and the second insulator plate 704. The change in alignment adjusts how electrical plating current is influenced by the first insulator plate 702 and the second insulator plate 704. According to some embodiments, the first insulator plate 702 is alternatively or additionally tilted at an angle with respect to the semiconductor wafer.

According to an aspect of the instant disclosure, a system for promoting metal plating profile uniformity is provided. The system comprises a first insulator plate disposed between a semiconductor wafer and an anode used for metal plating of the semiconductor wafer. The first insulator plate comprises a first insulator ring formed around a center porous region.

According to an aspect of the instant disclosure, a method for promoting metal plating profile uniformity is provided. The method comprises placing a first insulator plate between a semiconductor wafer and an anode. The first insulator plate comprises a first insulator ring and one or more first porous regions formed within the first insulator ring. A metal plating process is performed upon the semiconductor wafer using the anode and the first insulator plate.

According to an aspect of the instant disclosure, a system for promoting metal plating profile uniformity is provided. The system comprises a first insulator plate disposed between a semiconductor wafer and an anode used for metal plating of the semiconductor wafer. The first insulator plate comprises a first insulator ring and one or more first porous regions formed within the first insulator ring. The system comprises a second insulator plate disposed between the first insulator plate and the anode. The second insulator plate comprises a second insulator ring and one or more second porous regions formed within the second insulator ring.

Although the subject matter has been described in language specific to structural features or methodological acts, it is to be understood that the subject matter of the appended claims is not necessarily limited to the specific features or acts described above. Rather, the specific features and acts described above are disclosed as embodiment forms of implementing at least some of the claims.

Various operations of embodiments are provided herein. The order in which some or all of the operations are described should not be construed to imply that these operations are necessarily order dependent. Alternative ordering will be appreciated given the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Further, unless specified otherwise, "first," "second," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used, such terms are intended to be inclusive in a manner similar to "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A system for promoting metal plating profile uniformity, comprising:

a first insulator plate disposed between a semiconductor wafer and an anode used for metal plating of the semiconductor wafer, the first insulator plate comprising a first insulator ring formed around a first center porous region; and a second insulator plate disposed between the first insulator plate and the anode, wherein:

the second insulator plate comprises a second insulator ring formed around a second center porous region, a top surface of the first insulator ring lies in a first plane, a top surface of the semiconductor wafer lies in a second plane parallel to the first plane, and a top surface of the second insulator ring lies in a third plane that is not parallel to the first plane.

2. The system of claim 1, the first insulator ring formed as a single solid ring.

3. The system of claim 1, the first insulator plate comprising:

one or more porous regions formed within the first insulator ring.

4. The system of claim 1, the first insulator plate comprising:

a first porous region, formed within the first insulator ring, having a first size; and a second porous region, formed within the first insulator ring, having a second size different than the first size.

5. The system of claim 1, the first insulator plate comprising:

a first porous region, formed within the first insulator ring, having a first selectable size and a second selectable size.

6. The system of claim 3, the one or more porous regions formed according to a non-uniform distribution.

7. The system of claim 1, the first insulator plate comprising:

a first set of porous regions, formed within the first insulator ring, having a first distribution density; and a second set of porous regions, formed within the first insulator ring, having a second distribution density different than the first distribution density.

8. The system of claim 1, the first insulator plate having a first selectable distance setting and a second selectable distance setting, the first selectable distance setting corresponding to a first distance between the first insulator plate and the semiconductor wafer, the second selectable distance setting corresponding to a second distance, different than the first distance, between the first insulator plate and the semiconductor wafer.

9. The system of claim 3, the first insulator plate having a porosity of 10% or greater based upon the one or more porous regions and the first center porous region.

10. The system of claim 1, wherein the first insulator plate and the second insulator plate have a same material composition.

11. The system of claim 1, wherein the top surface of the first insulator ring is planar and the top surface of the second insulator ring is planar.

12. The system of claim 1, wherein:

the first insulator plate comprises one or more first porous regions formed within the first insulator ring according to a first distribution density, and the second insulator plate comprises one or more second porous regions formed within the second insulator ring according to a second distribution density different than the first distribution density.

13. The system of claim 1, wherein:

the first insulator plate comprises a plurality of first porous regions formed within the first insulator ring, the second insulator plate comprises a plurality of-second porous regions formed within the second insulator ring, and at least some of the plurality of first porous regions are spatially aligned with at least some of the plurality of second porous regions in a direction extending between the anode and the semiconductor wafer.

14. The system of claim 1, the second insulator plate having a first selectable distance setting and a second selectable distance setting, the first selectable distance setting corresponding to a first distance between the second insulator plate and the first insulator plate, the second selectable distance setting corresponding to a second distance, different than the first distance, between the second insulator plate and the first insulator plate.

15. The system of claim 1, the first insulator plate configured to rotate with respect to the second insulator plate to vary an alignment between one or more first porous regions formed within the first insulator ring and one or more second porous regions formed within the second insulator ring.

16. The system of claim 1, the second insulator plate configured to rotate with respect to the first insulator plate to vary an alignment between one or more first porous regions formed within the first insulator ring and one or more second porous regions formed within the second insulator ring.

17. A system for promoting metal plating profile uniformity, comprising:

a first insulator plate disposed between a semiconductor wafer and an anode used for metal plating of the semiconductor wafer, the first insulator plate comprising a first insulator ring and a plurality of first porous regions formed within the first insulator ring; and a second insulator plate disposed between the first insulator plate and the anode, the second insulator plate comprising a second insulator ring and a plurality of second porous regions formed within the second insulator ring, wherein:

the first insulator ring and the second insulator ring have a same material composition, and at least some of the plurality of first porous regions are spatially aligned with at least some of the plurality of second porous regions in a direction extending between the anode and the semiconductor wafer.

18. A system for promoting metal plating profile uniformity, comprising:

a first insulator plate disposed between a semiconductor wafer and an anode used for metal plating of the semiconductor wafer, the first insulator plate comprising a first insulator ring and a plurality of first porous regions formed within the first insulator ring; and a second insulator plate disposed between the first insulator plate and the anode, the second insulator plate comprising a second insulator ring and a plurality of second porous regions formed within the second insulator ring, wherein:

the first insulator ring and the second insulator ring have a same material composition, and the first insulator plate is rotatably mounted within a plating cell for rotation of the first insulator plate relative to the second insulator plate to vary an alignment between the plurality of first porous regions and the plurality of second porous regions.

19. The system of claim 18, a first porous region of the plurality of first porous regions having a first surface area and a first porous region of the plurality of second porous regions having a second surface area different than the first surface area.

20. The system of claim 18, the first insulator plate and the second insulator plate comprising a ceramic.

* * * * *